US005566808A

United States Patent [19]

Parker et al.

[11] Patent Number: 5,566,808

[45] Date of Patent: Oct. 22, 1996

[54] LOW PROFILE COIN ANALYZER APPARATUS

[75] Inventors: Donald O. Parker; Keith W. Parker, both of Grand Rapids, Mich.

[73] Assignee: Parker Engineering & Manufacturing Co., Grand Rapids, Mich.

[21] Appl. No.: 303,770

[22] Filed: Sep. 9, 1994

[51] Int. Cl.[6] ..... G07D 5/08

[52] U.S. Cl. ..... 194/317; 194/343; 194/346

[58] Field of Search ..... 194/317, 318, 194/338, 342, 343, 346

[56] References Cited

U.S. PATENT DOCUMENTS

| | | | |
|---|---|---|---|
| 1,017,454 | 2/1912 | Oswald | 194/338 |
| 1,945,948 | 2/1934 | Morin | 194/342 |
| 3,317,016 | 5/1967 | Turillon . | |
| 3,481,443 | 12/1969 | Meloni . | |
| 3,556,276 | 1/1971 | Pennell . | |
| 3,576,244 | 4/1971 | Ptacek et al. . | |
| 3,739,895 | 6/1973 | Fougere et al. . | |
| 3,741,363 | 6/1973 | Hinter-stocker . | |
| 3,796,295 | 3/1974 | Montolivo et al. . | |
| 3,797,307 | 3/1974 | Johnston . | |
| 3,837,454 | 9/1974 | Joeck . | |
| 3,901,368 | 8/1975 | Klinger . | |
| 3,939,953 | 2/1976 | Miyazawa . | |
| 3,980,168 | 9/1976 | Knight et al. . | |
| 4,084,677 | 4/1978 | Searle et al. . | |
| 4,089,400 | 5/1978 | Gregory, Jr. . | |
| 4,286,703 | 9/1981 | Schuller et al. | 194/317 |
| 4,432,447 | 2/1984 | Tanaka . | |
| 4,437,558 | 3/1984 | Nicholson et al. . | |
| 4,441,602 | 4/1984 | Ostroski et al. . | |
| 4,465,173 | 8/1984 | Domen et al . | |
| 4,582,189 | 4/1986 | Schmitt | 194/346 X |
| 4,625,851 | 12/1986 | Johnson et al. . | |
| 4,666,027 | 5/1987 | Ostroski et al. . | |
| 4,874,347 | 10/1989 | Kobayashi et al. | 194/338 X |
| 4,953,681 | 9/1990 | Zouzoulas | 194/346 |
| 5,056,644 | 10/1991 | Parker | 194/318 |
| 5,379,875 | 1/1995 | Shames et al. | 194/317 |
| 5,402,871 | 4/1995 | Mercurio | 194/343 X |

FOREIGN PATENT DOCUMENTS 1604536 12/1981 United Kingdom .

OTHER PUBLICATIONS

Photograph of mechanical coin acceptor manufactured by Hanke.

Series of photographs of a mechanical coin acceptor manufactured by Philips.

*Primary Examiner*—F. J. Bartuska

*Attorney, Agent, or Firm*—Van Dyke, Gardner, Linn & Burkhart, LLP

[57] ABSTRACT

An electronic coin analyzer having a low profile that is especially useful for applications previously limited to mechanical devices includes a test coin path aligned with a coin-receiving opening in a faceplate and a rejected coin path laterally offset from the test coin path and aligned with a coin reject slot in the faceplate. An opening is defined between the test coin path and the rejected coin path that is larger than an acceptable coin/token. A coin deflecting surface is selectively positioned in the test coin path at the opening by an electromagnetic actuator in order to laterally deflect coins rolling along the test coin path toward the rejected coin path. Coins not deflected continue rolling past the opening, as a result of inertia, to an accepted coin path. An electronic control is provided having a test coin sensor and a circuit which causes the actuator to withdraw the deflecting surface from the test coin path in response to an acceptable coin. Multiple denominations of coins and/or tokens may be accepted by providing the control with the capability of identifying a test coin in the test coin path as a particular one of a group of acceptable coins or tokens. A coin accelerator may be provided in the rejected coin path to intercept forward motion of the coin and convert this motion to motion in the opposite direction. A kicker device may be provided in the test coin path in order to accelerate a coin travelling through the test coin path.

19 Claims, 7 Drawing Sheets

LOW PROFILE COIN ANALYZER APPARATUS

BACKGROUND OF THE INVENTION

This invention relates generally to coin analyzer devices and, in particular, to coin analyzer devices that are used in the control or operation of coin operating machines such as, for example, video games and other coin-operated games, car washes, clothes washers and dryers, and the like. More particularly, the invention relates to an electronic coin analyzer having a faceplate that is compact in configuration, particularly in the vertical dimension.

Coin analyzing devices, which have been developed for use with coin-operated machines, were initially primarily mechanical in nature. Each coin inserted into the device, either through a slot or by a moving push mechanism, was subjected to one or more tests based upon the size, weight, or magnetic properties of the coin. Such devices were often fooled into accepting slugs or coins of foreign currencies worth less than the intended currency. Additionally, such mechanical coin detectors were limited to accepting coins or tokens of a particular value but not more than one denomination coin or token. Another difficulty with known mechanical coin analyzing devices is the susceptibility of such devices to jamming as a result of moisture., debris, or the like on the coin as it traverses the coin path. This problem is especially acute in applications involving water, such as laundromats and car washes.

Electronic coin analyzers have been developed to overcome many of the limitations of the prior mechanical devices. For example, in my U.S. Pat. Nos. 4,884,672 and 5,056,644 entitled COIN ANALYZER SYSTEM AND APPARATUS, I disclose a coin analyzer system and apparatus that provides a detection circuit for comparing a tested coin with at least two different sample coins. In the event the tested coin does not match either sample, a rejection gate forces the tested .coin, which is in free-fall, out of the coin chute in a laterally normal direction and into a rejected coin chute. In the event that the test coin matches either of the sample coins or tokens, the rejecting gate is opened and a test coin drops through a substantially vertical accepted coin chute. One difficulty with replacing mechanical coin acceptor devices with electronic systems is that electronic systems, especially those capable of accepting more than one denomination coin, or a coin and a token, have not fit within the same faceplate dimensions of the devices they are intended to replace. Manufacturers of the coin-operated equipment are reluctant to modify the space allocated to the coin analyzer system because such modification would create a disparity between newly installed equipment and existing equipment in the field. Importantly, coin analyzer systems added to the newly installed coin-operated machines under such circumstances would not be useable with existing coin-operated machines in the field.

Accordingly, there is a need for an electronic coin analyzer system and apparatus that may be directly retrofitted to coin-operated machines having mechanical coin analyzer devices.

SUMMARY OF THE INVENTION

The present invention is embodied in a coin analyzer apparatus, including a faceplate having openings defining coin receiving and coin rejecting slots. A coin receiving path is aligned with the coin receiving slot and has a coin support surface and a pair of parallel spaced apart guide walls on opposite sides of the support surface. A rejected coin path is positioned laterally offset from the coin receiving path and aligned with the coin receiving slot. The rejected coin path has a portion overlapping a portion of the coin receiving path and an opening is defined in one of the .guide walls at the overlapping portion. In this manner, a coin may be laterally deflected from the coin receiving path to the rejected coin path. A coin deflection surface is selectively positioned in the coin receiving path at the overlapping portions for laterally deflecting coins off of the support surface toward the rejected coin path. The coin receiving path terminates in a coin acceptance path that is laterally colinear with the coin support surface. In this manner, coins that are not deflected off of the support surface by the deflection surface will travel in a straight line to the coin acceptance path. This arrangement allows an exceptional amount of drop from the coin deflection area to the rejected coin slot and the coin acceptance path while maintaining a close proximity between the coin receiving slot and the rejected coin slot.

These and other objects, advantages, and features of this invention will become apparent upon review of the following specification in conjunction with the drawings.

DESCRIPTION OF THE PREFERRED EMBODIMENT

Figure 1:
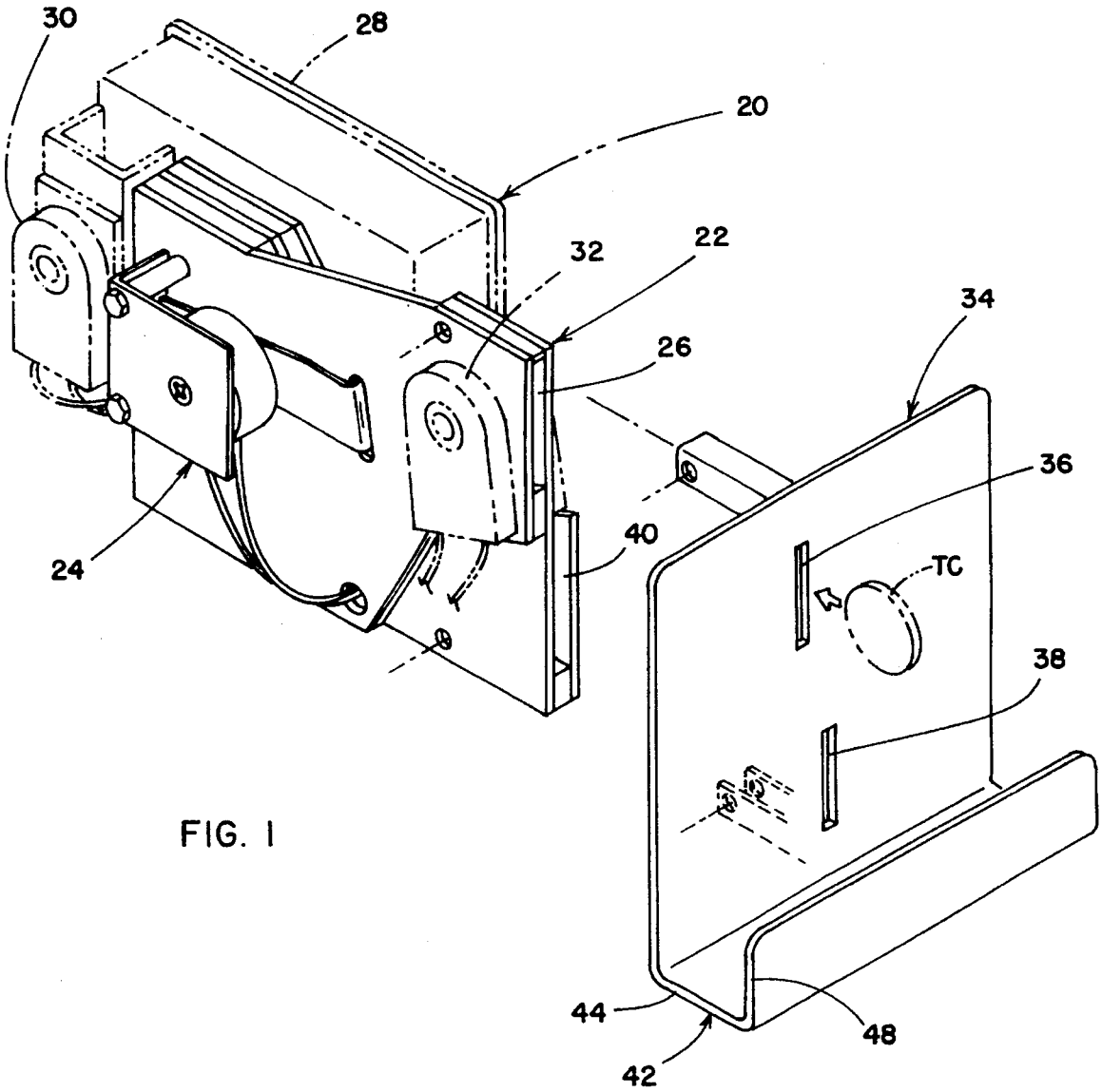
FIG. 1 is a partially exploded perspective view of a coin analyzer apparatus, according to the invention.
Figure 2:
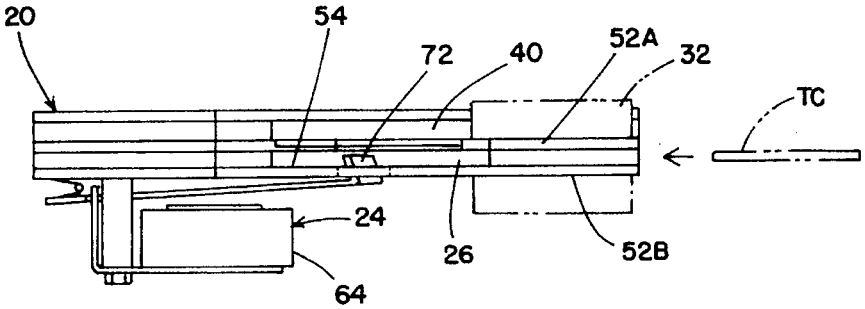
FIG. 2 is a top plan view of the apparatus in FIG. 1.
Figure 3:
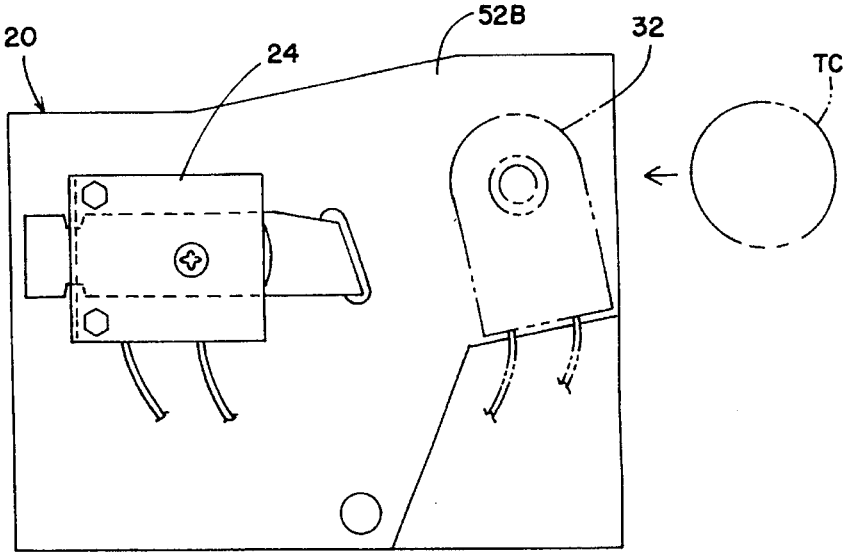
FIG. 3 is a left side elevation of the apparatus in FIG. 1.
Figure 4:
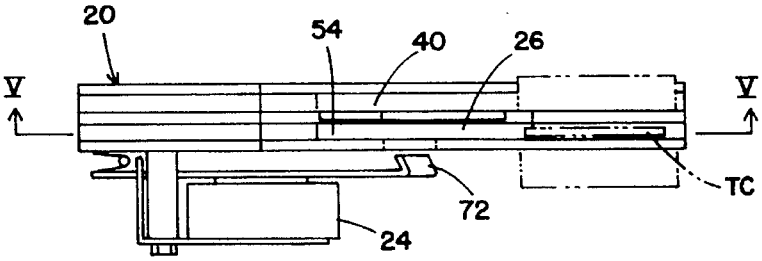
FIG. 4 is the same view as FIG. 2 illustrating the apparatus in a state of accepting a coin.

As used throughout this patent application, the terms "coin," "token," and "slug" are used interchangeably and are to be considered equivalent unless specified to the contrary. Referring now specifically to the drawings and the illustrative embodiments depicted therein, a coin analyzer apparatus 20 includes a mechanical assembly 22 through which is defined a series of coin traversing pathways and having a solenoid-operated actuator 24 which effectuates either the acceptance or rejection of a coin inserted into a test coin path, or coin receiving path, 26 (FIG. 1 ). Actuator 24 is operated by an electronic assembly 28. Electronic assembly 28 may be of the type disclosed in U.S. Pat. No. 5,056,644 issued to Donald O. Parker for a COIN ANALYZER SYSTEM AND APPARATUS or in U.S. Pat. No. 4,437,558 issued to Donald O. Parker and another inventor for a COIN DETECTOR APPARATUS, the disclosures of which are hereby incorporated herein by reference. The structure and operation of embodiments of electronic assembly 28 is disclosed in detail in said patents and will not be repeated herein. Suffice it to say that electronic assembly 28 includes one or more sample coin holders 30, either of which retains a coin or token of a denomination intended to be accepted by coin analyzer apparatus 20. Electronic assembly 28 further includes a test coin sensor assembly 32, which straddles test coin path 26 and through which a coin passes while traveling along test coin path 26. If the coin traversing the test coin sensor assembly 32 matches a sample coin in sample coin holder(s) 30, an appropriate credit is given by electronic assembly 28 provided that a coin verification sensor, such as a photodetector (not shown), verifies that a coin has entered the accepted coin bin (not shown).

Coin analyzer apparatus 20 further includes a faceplate 34 having openings defining a coin receiving slot 36 aligned with test coin path 26 and a rejected coin slot 38 aligned with a rejected coin path 40. Faceplate-34 further includes a rejected coin tray 42 defined by a bottom wall 44 extending horizontally forwardly from a vertical face portion 46 of faceplate 34 and a retaining flange 48 extending upwardly from the forward portion of bottom wall 44. Rejected coin tray 42 extends the full lateral width of faceplate 34 and thereby allows rejected coins to fully exit rejected coin slot 38 to prevent a backup of coins in rejected coin path 40. This eliminates one source of coin jamming in previous coin analyzer devices.

Figure 5:
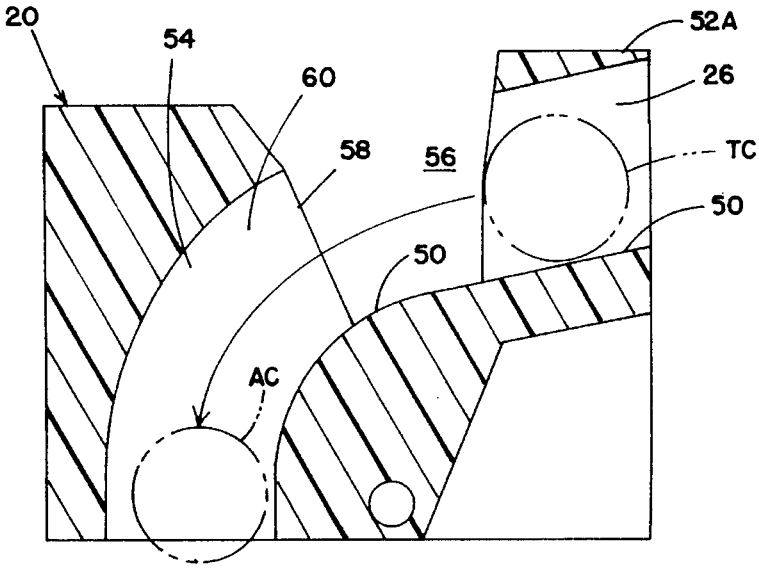
FIG. 5 is a sectional view taken along the lines V—V in FIG. 4 illustrating an accepted coin traveling from a coin receiving path to a coin acceptance path.

Test coin path 26 includes a coin supporting surface 50 laterally enclosed by a pair of parallel, spaced apart lateral sidewalls 52*a*, 52*b*. As best seen in FIG. 5, the cavity between sidewalls 52*a*, 52*b* defining test coin path 26 extends forwardly, away from faceplate 34, into accepted coin path 54 in a manner that accepted coin path 54 is in direct alignment with test coin path 26 and coin support surface 50 extends continuously, and without abrupt bends, from test coin path 26 to accepted coin path 54. Rejected coin path 40 is laterally offset from test coin path 26 and partially separated therefrom by sidewall 52*a*. An opening 56 in sidewall 52*a*, which is approximately at least the size of a coin and extends downwardly to an elevation flush with support surface 50, provides a passage for coins between test coin path 26 and rejected coin path 40. An edge 58 of sidewall 52*a*, which defines a portion of opening 56, divides a coin receiving portion 60 of accepted coin path 54 from a coin receiving portion 62 of rejected coin path 40. Edge 58 and opening 56 prevents a coin whose leading edge is diverted in the direction of rejected coin path 40 from entering accepted coin path 54. Once the coin leading edge is diverted to the rejection side of edge 58, the coin begins to fall off of support surface 50 and cannot be redirected onto the support surface.

Actuator 24 includes a solenoid 64, which selectively attracts an arm 66 in response to the solenoid being actuated by electronic assembly 28. Arm 66 is pivoted at one end 68 thereof and is biased away from solenoid 64 by a torsion spring 70. Arm 66 includes an opposite end 69 that terminates in a coin deflecting surface 72. Coin deflecting surface 72 is substantially vertical but slightly sloped away from slot 36 upwardly. Coin deflecting surface 72 is also sloped in the direction of rejected coin path 40. When actuated, solenoid 64 attracts arm 66 which withdraws coin deflecting surface 72 from test coin path 26. When solenoid 64 is not actuated, spring 70 moves arm 66 away from solenoid 64 and thereby positions coin deflecting surface 72 in test coin path 26.

Figure 6:
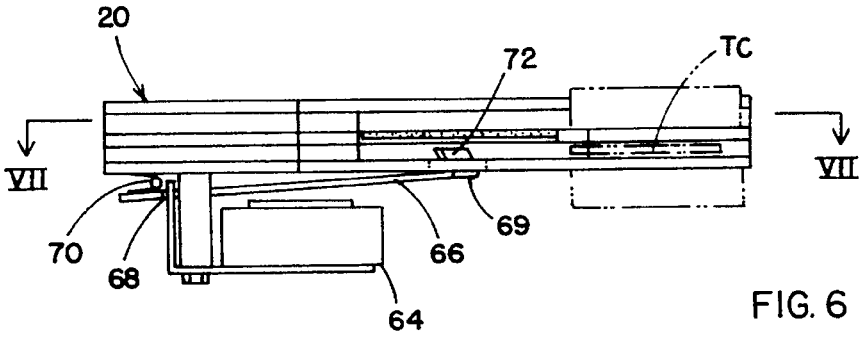
FIG. 6 is the same view as FIG. 2 illustrating the apparatus in a state of rejecting a coin.
Figure 7:
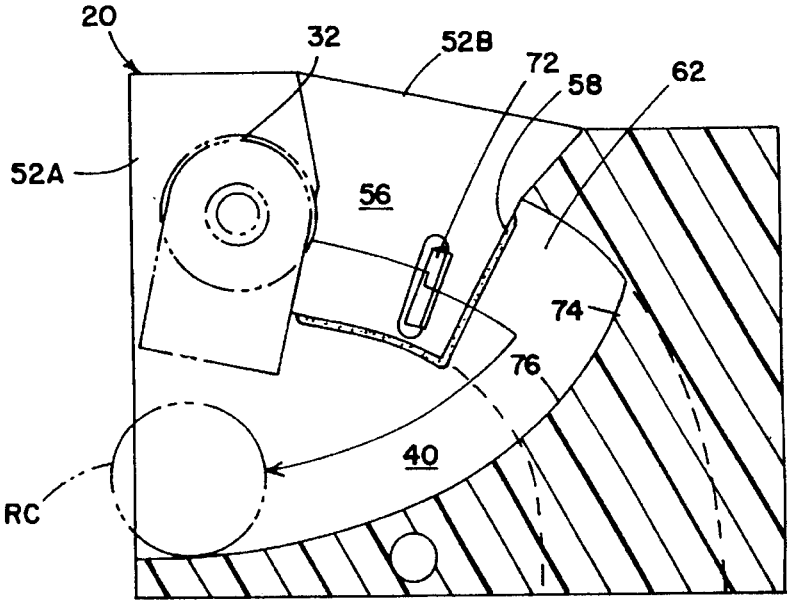
FIG. 7 is a sectional view taken along the lines VII—VII in FIG. 6 illustrating a rejected coin traveling from a coin receiving path to a rejected coin path.
Figure 8:
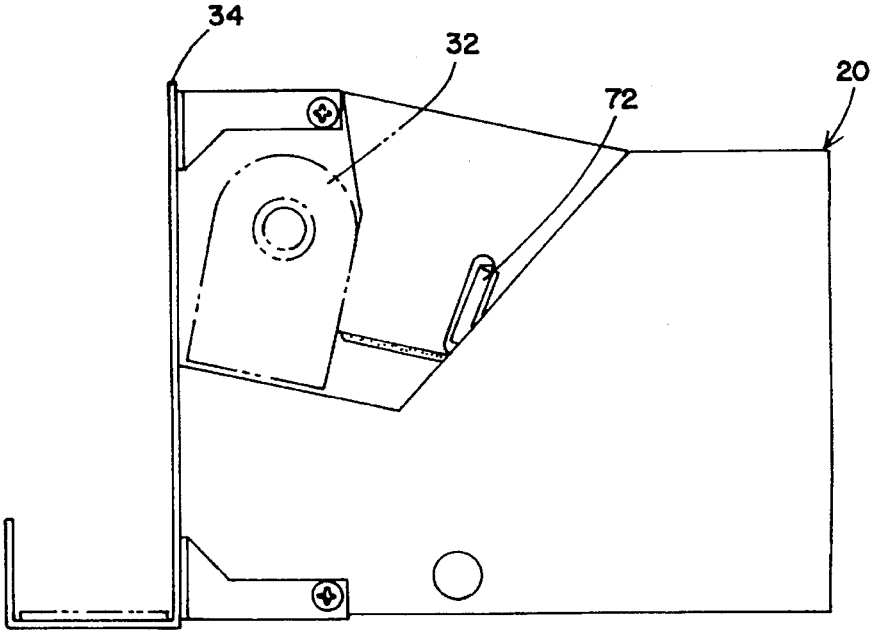
FIG. 8 is a right side elevation of the apparatus in FIG. 1.
Figure 9:
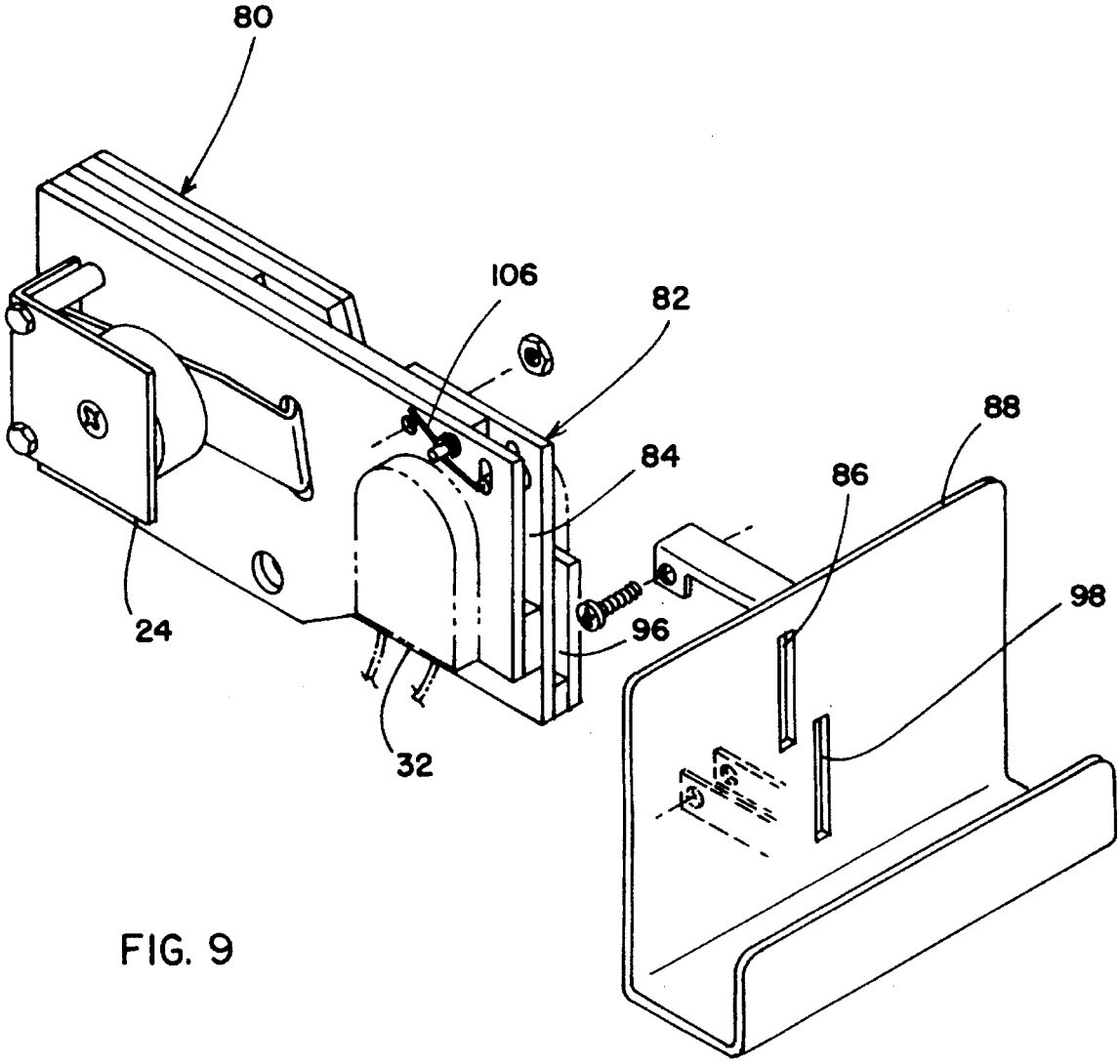
FIG. 9 is a partially exploded perspective view of an alternative embodiment of a coin analyzer apparatus, according to the invention.
Figure 10:
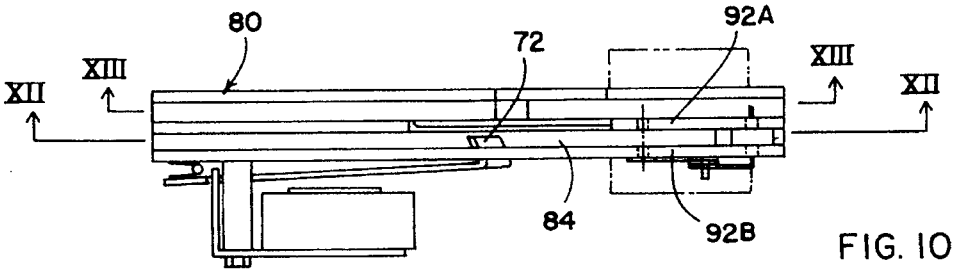
FIG. 10 is a top plan view of the apparatus in FIG. 9.
Figure 11:
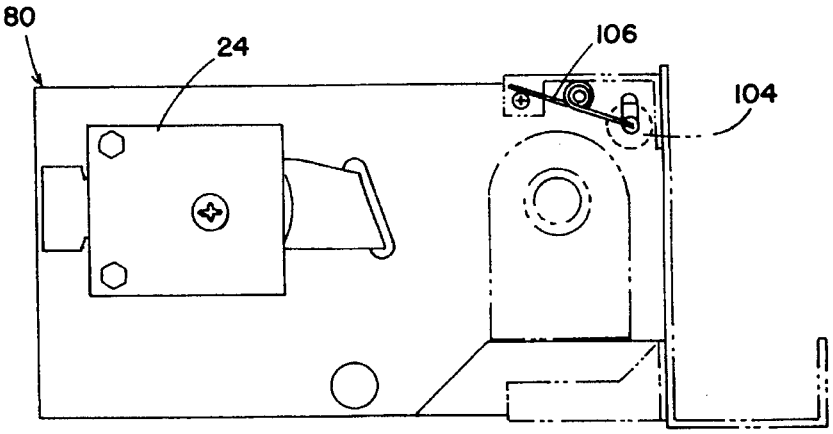
FIG. 11 is a left side elevation of the apparatus in FIG. 9.
Figure 12:
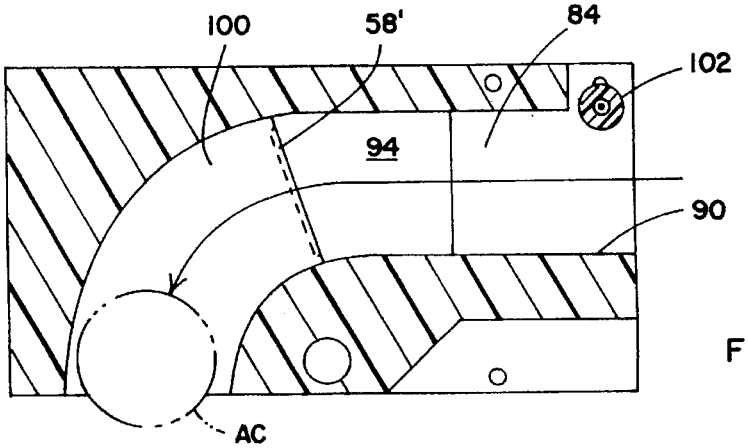
FIG. 12 is a sectional view taken along the lines XII—XII in FIG. 10 illustrating a coin being accepted by the apparatus.
Figure 13:
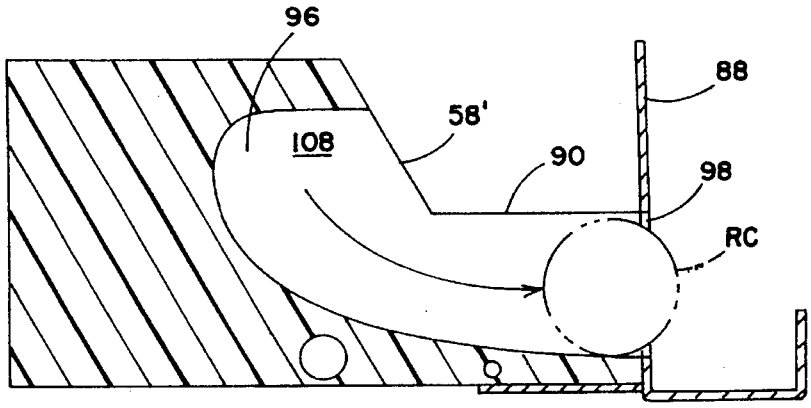
FIG. 13 is a sectional view taken along the lines XIII—XIII in FIG. 10 illustrating a coin being rejected by the apparatus.
Figure 14:
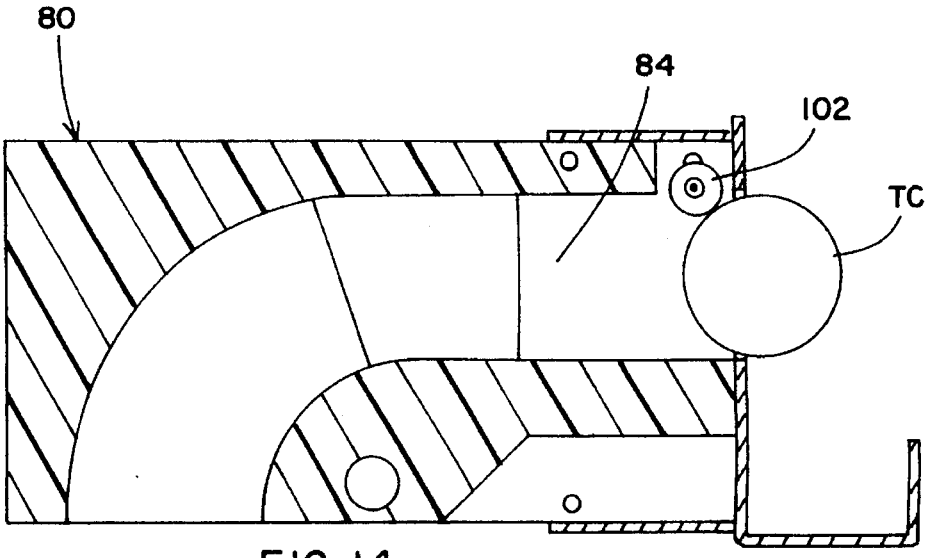
FIGS. 14–16 illustrate sequentially the insertion of a coin in the apparatus illustrated in FIG. 9.
Figure 15:
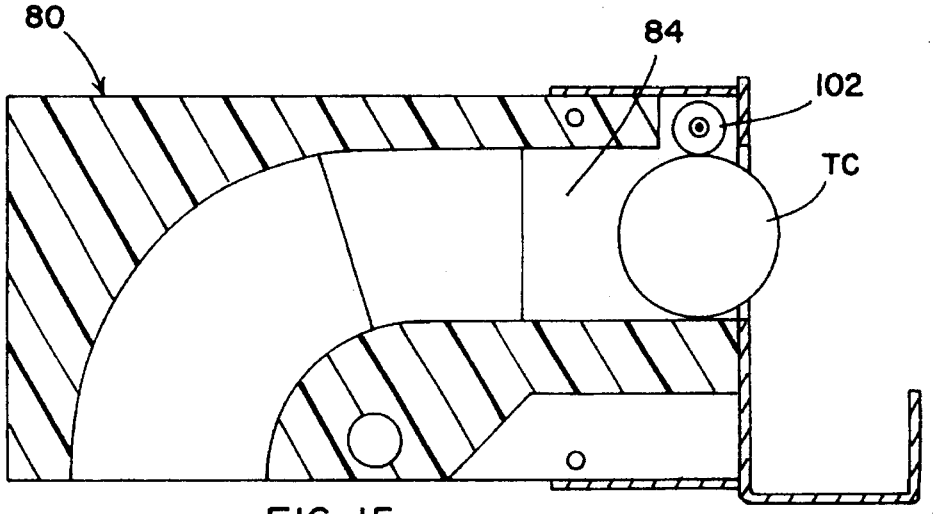
Figure 16:
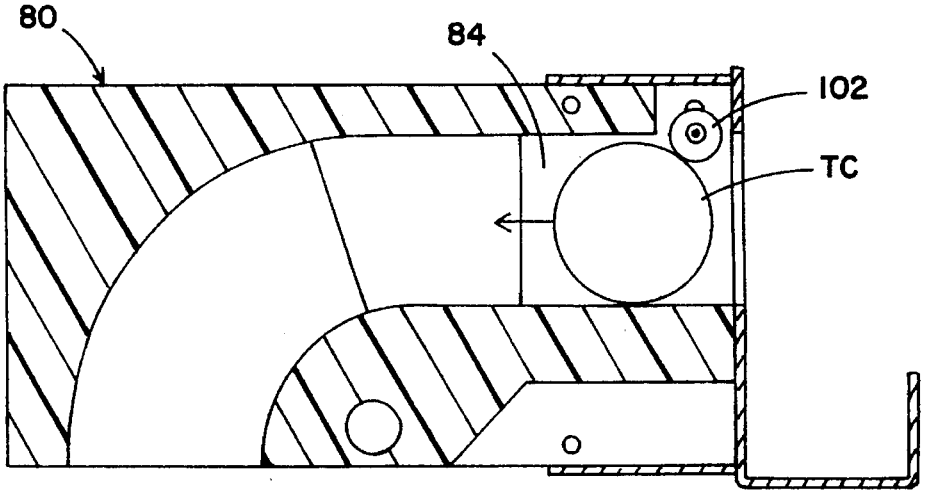

When a test coin TC is inserted in coin receiving slot 36, the coin passes through test coin sensor assembly 32 while the test coin travels along test coin path 26 on coin supporting surface 50. Before the coin reaches coin deflecting surface 72, electronic assembly 28 determines whether the test coin is a valid coin and, if so, actuates solenoid 64 in order to retract coin deflecting surface 72 from test coin path 26. With coin deflecting surface 72 withdrawn, the test coin TC continues to travel along coin support surface 50 into coin accepting path 54 as an accepted coin AC (FIG. 5). Because the coin is rolling along coin support surface 50, the coin has rotational inertia which keeps the coin traveling in a straight line along coin support surface 50, much the same as the rotation of the wheels of a bicycle keeps the bicycle upright. If electronic assembly 28 determines that test coin TC is not a genuine coin or not a coin matching the coin in sample coin holder 30, electronic assembly 28 does not actuate coil 64. Test coin TC will, therefore, strike coin deflecting surface 72, which will deflect the leading edge of the coin toward rejected coin path 40, as best illustrated in FIGS. 6 and 7. This deflection of the leading edge of the coin causes the coin to pass to the coin receiving portion 62 side of edge 58 and thereby enters the rejected coin path 40. Rejected coin path 40 includes a coin accelerator 74 in the form of a curved surface 76 whose upstream portion, in the direction of travel of the coin, is generally vertical and whose downstream portion is generally horizontal. Coin accelerator 74 accelerates a rejected coin from coin receiving portion 62 forwardly out rejected coin slot 38. Alternatively, a mechanical device, such as a spring-loaded mechanism, could be utilized instead of a sloping surface for coin accelerator 74 in order to accelerate the coin in the coin receiving portion of the rejected coin path. The rotational inertia of the coin traveling along support surface 50 additionally assist in the positive movement of the coin into rejected coin path 40 because the coin deflecting surface 72 need only steer the leading edge of the coin the width of edge 58. Once the leading edge of the coin has been deflected by said amount, the coin is irretrievably destined for the rejected coin path 40. In a preferred embodiment, edge 58 is beveled, sloping in the direction of rejected coin path 40, in order to reduce the amount of deflecting of the leading edge of the coin required in order to deflect the coin into the rejected coin path.

The coin receiving portions 60 and 62, respectively, of the accepted coin path and the rejected coin path overlap. This allows a maximum vertical drop in the rejected coin path without requiring extensive vertical separation between coin receiving slot 36 and rejected coin slot 38. This allows faceplate 34 to be compact, especially in the vertical direction, which is required to fit existing openings for mechanical coin analyzing devices. The significant vertical drop in both the accepted coin path and the rejected coin path ensures a rapid movement of the coin in an unobstructed fashion through the mechanical assembly, thereby significantly reducing the tendency for a coin to become retained in any of the pathways due to moisture or other surface contaminate of the coin. An additional important feature of coin analyzer apparatus 20 is that the force imparted upon coin deflecting surface 72 by a coin extends generally in the direction of pivot 68. This is accomplished by positioning pivot 68 downstream from coin deflecting surface 72 in the direction of a coin traveling along the test coin path. Because such force passes close to the pivot, there is a significant reduction in the rotational couple imparted by a coin on arm 66. Therefore, a person attempting to defraud the coin-operated machine by "shooting" coins into test coin slot 36 will not be able to force coin deflecting surface 72 momentarily out of test coin path 26 to thereby defeat coin analyzer apparatus 20. Furthermore, as previously mentioned, even a slight deflection of the leading edge of a coin will result in the coin entering the reject coin path 40. Accordingly, the ability to "shoot" a coin is significantly eliminated.

Particular coin-operated machines utilize hand-operated coin plungers, which are adapted to an exceptionally small vertical profile. In order to accommodate such an opening with an electronic coin analyzer apparatus having both a coin receiving slot and a rejected coin slot, it is necessary to vertically overlap the slots. This is accomplished in a coin analyzer apparatus 80 having a mechanical assembly 82 and an actuator 24' (FIGS. 9–16). Coin analyzer apparatus 80 includes a test coin sensor assembly 32' and an electronic assembly and sample coin holder (not shown) identical to that illustrated with respect to coin analyzer apparatus 20. Mechanical assembly 82 defines various coin pathways including a test coin path 84 that is aligned with a coin receiving slot 86 in a faceplate 88. Test coin path 84 is defined by a coin support surface 90, which is laterally enveloped by vertical sidewalls 92*a* and 92*b*. An opening 94 in sidewall 92*b*, approximately at least the size of a coin and projected upwardly from support surface 90, extends into a rejected coin path 96, which is laterally offset from test coin path 84 and extends forwardly into a rejected coin slot 98 in faceplate 88. The cavity defining test coin path 84 extends forwardly into an accepted coin path 100, which is formed from sidewalls 92*a* and 92*b* and an extension of coin support surface 90.

Figure 18:
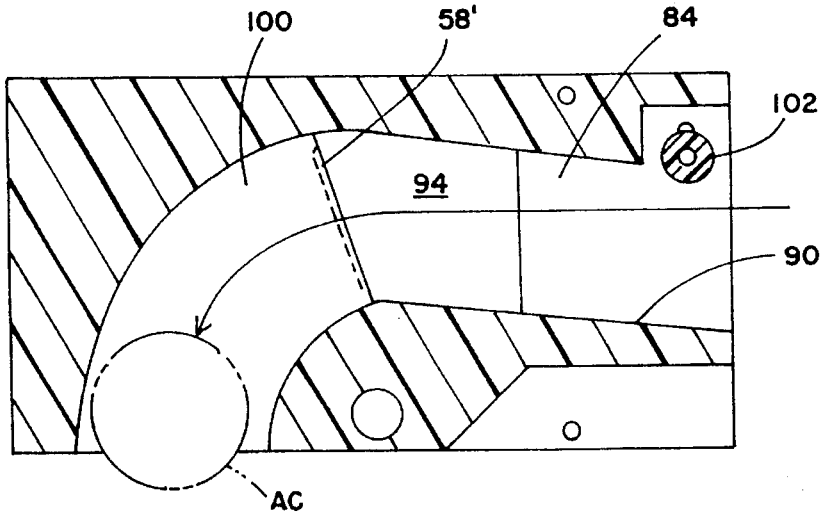
FIG. 18 is the same view as FIG. 12 of a second alternative embodiment of a coin analyzer apparatus, according to the invention.
Figure 19:
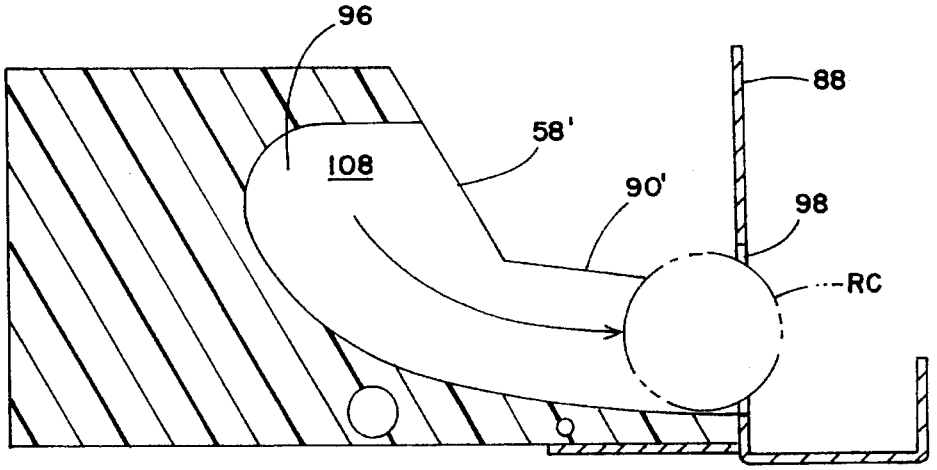
FIG. 19 is the same view as FIG. 13 of the apparatus in FIG. 18.

Apparatus 80 further includes a kicker device 102 positioned in test coin path 84 at a height above coin support surface 90 that will be impacted by a coin of any valid denomination inserted in test coin slot 86. Kicker 102, in the illustrated embodiment, includes a wheel 104, which is spring-mounted by a torsion spring 106. As best seen by comparing FIGS. 14–16, a test coin TC inserted in test coin slot 86 meets resistance from kicker 102 initially upon insertion. As the user forces test coin TC further into the slot, kicker 102 is deflected upwardly storing energy in spring 106. As the maximum diameter of coin TC passes beyond the kicker 102, the energy stored in spring 106 accelerates coin TC forwardly away from the faceplate. This forward motion, imparted to the test coin TC by kicker 102, allows coin support surface 90 to be substantially horizontal. Alternatively, as illustrated in FIGS. 18 and 19, the forward motion imported to the test coin TC by kicker 102 allows a coin support surface 90' to be provided which is sloping upwardly away from coin receiving slot 86. This allows the coin receiving portion 108 of rejected coin path 96 to be elevated even further by comparison to coin receiving portion 62 of apparatus 20, and, thereby, allows coin rejection slot 98 to be elevated with respect to coin receiving slot 86. In this manner, coin rejecting slot 98 may be made to vertically overlap all or a portion of coin receiving slot 86. The forward momentum imparted on the test coin TC by kicker 102 allows the test coin to move in a forward direction into coin accepting path 100 if actuator 24 is actuated or to be deflected in coin receiving portion 108 of rejected coin path 96 if actuator 24' is not actuated. In all other respects, the operation of coin analyzer apparatus 80 is identical with that of coin analyzer apparatus 20. Kicker 104 could, alternatively, be positioned at a lower portion of test coin path 84, or two kickers could be provided in a manner that the test coin passes between them.

Figure 17:
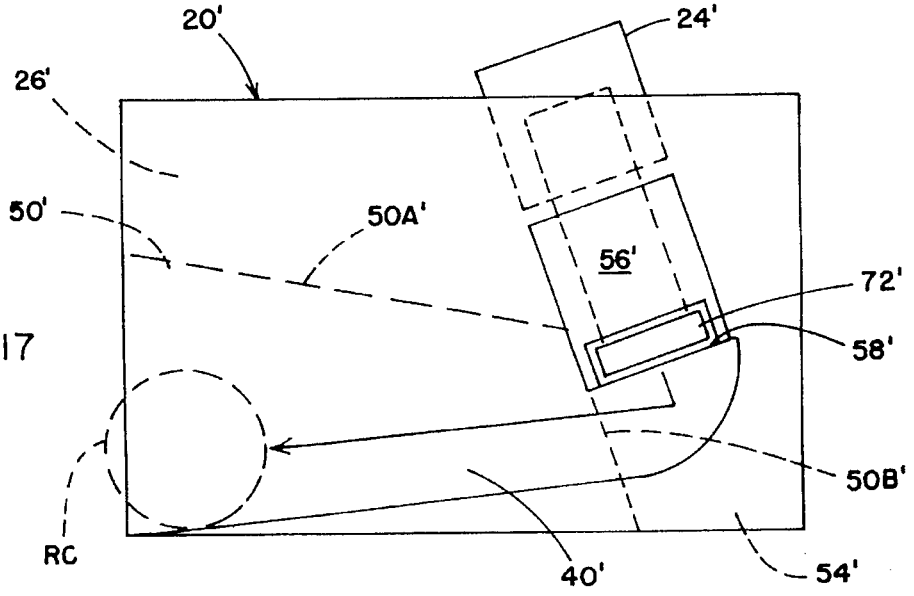
FIG. 17 is the same view as FIG. 7 of another alternative embodiment of a coin analyzer apparatus, according to the invention.

An alternative coin analyzer apparatus 20' is provided that includes a coin support surface 50' that is divided into two generally linear surface portions 50*a'* and 50*b'* (FIG. 17). Surface portion 50*a'* is downwardly sloping from the coin receiving slot (not shown) at a slope that ensures the test coin will be rolling along the surface portion. Surface portion 50*b'*, which begins just upstream from coin deflecting surface 72', has a significantly steeper slope than surface portion 50*b'*. However, the test coin will still be in rolling rotation when the coin encounters coin deflecting surface 72'. As with previously described embodiments, support surface 50' continues forwardly into accepted coin path 54' so that by energizing an actuator 24' to withdraw deflecting surface 72' from test coin path 26', an accepted coin will be traveling in the same general direction in the accepted coin path as it traveled in the test coin path. Coin deflecting surface 72' is generally normal surface portion 50*b'* of coin support surface 50' so that a coin may be diverted into rejected coin path 40' by diverting the leading edge of a coin the width of an edge 58' of opening 56', through which the coin passes.

Thus, it is seen that the present invention provides an electronic coin analyzer apparatus that is capable of being adapted to the faceplate openings for prior mechanical coin acceptors. This allows the benefits of my prior patents, namely the ability to accurately discriminate a slug from a valid coin and to accurately determine the denomination of a valid coin and to accept both coins and tokens in the same coin analyzer apparatus, to be applied to machines now using mechanical coin acceptors. Moreover, the present invention provides an exceptionally rapid movement of the coins through the coin pathways and thereby significantly reduces the tendency of the coin to get jammed in the coin pathways. Furthermore, should a jam occur, the coin analyzer apparatus disclosed herein may be cleared by the simple use of a flat stick, or other simple implement, rather than requiring disassembly of the coin-operated machine in order to clear the jam. In addition, the present coin analyzer apparatus accommodates a variety of size coins ranging, for example, from a United States dime to a silver dollar.

Changes and modifications in the specifically described embodiments can be carried out without departing from the principles of the invention, which is intended to be limited only by the scope of the appended claims as interpreted according to the principles of patent law including the doctrine of equivalents.

The embodiments of the invention in which an exclusive property or privilege is claimed are defined as follows:

1. A low profile coin analyzer apparatus comprising:

a faceplate including slots defining coin receiving and coin rejecting slots in said faceplate;

a test coin path aligned with said coin-receiving slot and defined by a coin support surface and a pair of parallel spaced apart guide walls on opposite sides of said support surface:

a rejected coin path laterally offset from said test coin path aligned with said coin rejecting slot and an opening defined in said one of said guide walls between said test coin path and said rejected coin path, said opening is at least as large as an acceptable coin or token, wherein a coin may be laterally deflected from said coin support surface to said rejected coin path through said opening;

a coin deflecting surface selectively positioned in said test coin path at said opening and an electromagnetic actuator for selectively positioning said coin deflecting surface in said test coin path for laterally deflecting coins off said support surface toward said rejected coin path;

an electronic assembly having a test coin sensor and a circuit which causes said actuator to withdraw said coin deflecting surface from said test coin path in response to said control identifying an acceptable coin or token; and said test coin path terminating in an accepted coin path laterally collinear with said test coin path, wherein coins not deflected off said support surface by said coin deflecting surface will roll freely along said coin support surface past said opening as a result of rolling inertia in a same general direction to said accepted coin path;

wherein said coin deflection surface slopes away from said support surface toward said coin acceptance path.

2. The coin analyzer apparatus in claim 1 wherein said actuator including an arm supporting said coin deflection surface at one end and supported by a pivot at an opposite end in a manner that forces imparted by coins on said coin deflection surface are directed in the general direction of said pivot.

3. The coin analyzer apparatus in claim 2 wherein said pivot is positioned downstream from said coin deflection surface in the direction of movement of a coin in said coin receiving path.

4. The coin analyzer apparatus in claim 1 wherein said control is capable of identifying a test coin in said test coin path as a particular one of a group of acceptable coins or tokens and wherein said test coin path is larger than the largest of said group, whereby said apparatus is capable of accepting and identifying multiple denominations of coins and/or tokens and rejecting slugs.

5. A low profile coin analyzer apparatus comprising:

a faceplate including slots defining coin receiving and coin rejecting slots in said faceplate;

a test coin path aligned with said coin-receiving slot and defined by a coin support surface and a pair of parallel spaced apart guide walls on opposite sides of said support surface;

a rejected coin path laterally offset from said test coin path aligned with said coin rejecting slot and an opening defined in said one of said guide walls between said test coin path and said rejected coin path, said opening is at least as large as an acceptable coin or token, wherein a coin may be laterally deflected from said coin support surface to said rejected coin path through said opening, wherein said opening defines an edge between said test coin path and said rejected coin path in the direction of movement of a coin in said coin receiving path, wherein said edge is beveled;

a coin deflecting surface selectively positioned in said test coin path at said opening and an electromagnetic actuator for selectively positioning said coin deflecting surface in said test coin path for laterally deflecting coins off said support surface toward said rejected coin path;

an electronic assembly having a test coin sensor and a circuit which causes said/actuator to withdraw said coin deflecting surface from said test coin path in response to said control identifying an acceptable coin or token; and said test coin path terminating in an accepted coin path laterally collinear with said test coin path, wherein coins not deflected off said support surface by said coin deflecting surface will roll freely along said coin support surface past said opening as a result of rolling inertia in a same general direction to said accepted coin path.

6. The coin analyzer apparatus in claim 5 wherein said coin deflection surface is oriented generally normal to said coin support surface and sloping in the direction of said rejected coin path.

7. The coin analyzer apparatus in claim 5 wherein said coin support surface slopes downwardly in the direction of movement of a coin in said coin receiving path, whereby a coin is rolling along said coin support surface at said opening.

8. The coin analyzer apparatus in claim 5 wherein said control is capable of identifying a test coin in said test coin path as a particular one of a group of acceptable coins or tokens and wherein said test coin path is larger than the largest of said group, whereby said apparatus is capable of accepting and identifying multiple denominations of coins and/or tokens and rejecting slugs.

9. A low profile coin analyzer apparatus comprising:

a faceplate including slots defining coin receiving and coin rejecting slots in said faceplate that are at least partially vertically overlapping;

a test coin path aligned with said coin receiving slot and defined by a coin support surface and a pair of parallel spaced apart guide walls on opposite sides of said support surface, wherein said support surface slopes upwardly in the direction of movement of a coin in said test coin path:

a rejected coin path laterally offset from said test coin path aligned with said coin rejecting slot and an Opening defined in said one of said guide walls between said test coin path and said rejected coin path whereby a coin may be laterally deflected from said coin support surface to said rejected coin path through said opening:

a coin deflecting surface selectively positioned in said test coin path at said opening and an electromagnetic actuator for selectively positioning said coin deflecting surface in said test coin path for laterally deflecting coins off said support surface toward said rejected coin path;

an electronic assembly having a test coin sensor and a circuit which causes said actuator to withdraw said coin deflecting surface from said test coin path in response to said control identifying an acceptable coin or token;

said test coin path terminating in an accepted coin path laterally collinear with said test coin path, wherein coins not deflected off said support surface by said coin deflecting surface will roll freely along said coin support surface past said opening as a result of rolling inertia in a same general direction to said accepted coin path; and a kicker device in said test coin path adjacent said coin receiving slot, said kicker device accelerating a coin traveling through said test coin path in order to provide inertia to traverse the test coin path.

10. The coin analyzer apparatus in claim 9 wherein said kicker device stores energy as a result of insertion of a coin in said coin receiving slot and delivers stored energy to the coin as the coin passes the kicker device.

11. The coin analyzer apparatus in claim 9 wherein said control is capable of identifying a test coin in said test coin path as a particular one of a group of acceptable coins or tokens and wherein said test coin path is larger than the largest of said group, whereby said apparatus is capable of accepting and identifying multiple denominations of coins and/or tokens and rejecting slugs.

12. A low profile coin analyzer apparatus comprising:

a faceplate including slots defining coin receiving and coin rejecting slots in said faceplate;

a test coin path aligned with said coin receiving slot and defined by a coin support surface and a pair of parallel spaced apart guide walls on opposite sides of said support surface;

a rejected coin path laterally offset from said test coin path aligned with said coin rejecting slot and an opening defined in said one of said guide walls between said test coin path and said rejected coin path whereby a coin may be laterally deflected from said coin support surface to said rejected coin path through said opening;

a coin deflecting surface selectively positioned in said test coin path at said opening and an electromagnetic actuator for selectively positioning said coin deflecting surface in said test coin path for laterally deflecting coins off said support surface toward said rejected coin path;

an electronic assembly having a test coin sensor and a circuit which causes said actuator to withdraw said coin deflecting surface from said test coin path in response to said control identifying an acceptable coin or token;

said test coin path terminating in an accepted coin path laterally collinear with said test coin path, wherein coins not deflected off said support surface by said coin deflecting surface will roll freely along said coin support surface past said opening as a result of rolling inertia in a same general direction to said accepted coin path; and a coin accelerator in said rejected coin path that intercepts forward motion of the coin away from the faceplate and converts said forward motion to motion in the opposite direction toward said faceplate.

13. The coin analyzer apparatus in claim 12 wherein said coin accelerator includes a curvilinear surface extending from a generally vertical orientation at said opening to a generally horizontal orientation at said rejected coin slot.

14. The coin analyzer apparatus in claim 12 wherein coin receiving portions of said rejected coin paths and said accepted coin path are laterally spaced and overlapping.

15. The coin analyzer apparatus in claim 12 wherein said control is capable of identifying a test coin in said test coin path as a particular one of a group of acceptable coins or tokens and wherein said test coin path is larger than the largest of said group, whereby said apparatus is capable of accepting and identifying multiple denominations of coins and/or tokens and rejecting slugs.

16. A low profile coin analyzer apparatus comprising:

a faceplate including slots defining coin receiving and coin rejecting slots in said faceplate;

a test coin path aligned with said coin-receiving slot and defined by a coin support surface and a pair of parallel spaced apart guide walls on opposite sides of said support surface, wherein said coin support surface is divided into first and second collinear surface portions, said first surface portion being closest to said coin receiving slot and having a given downward slope in the direction of movement of a coin and said second surface portion having a downward slope in the direction of movement of a coin that is greater than said first surface portion:

a rejected coin path laterally offset from said test coin path aligned with said coin rejecting slot and an opening defined in said one of said guide walls between said test coin path and said rejected coin path, said opening is at least as large as an acceptable coin or token, wherein a coin may be laterally deflected from said coin support surface to said rejected coin path through said opening;

a coin deflecting surface selectively positioned in said test coin path at said opening and an electromagnetic actuator for selectively positioning said coin deflecting surface in said test coin path for laterally deflecting coins off said support surface toward said rejected coin path;

an electronic assembly having a test coin sensor and a circuit which causes said actuator to withdraw said coin deflecting surface from said test coin path in response to said control identifying an acceptable coin or token; and said test coin path terminating in an accepted coin path laterally collinear with said test coin path, wherein coins not deflected off said support surface by said coin deflecting surface will roll freely along said coin support surface past said opening as a result of rolling inertia in a same general direction to said accepted coin path.

17. The coin analyzer apparatus in claim 16 wherein said coin deflecting surface is positioned at said second surface portion.

18. The coin analyzer apparatus in claim 17 wherein said coin deflecting surface is oriented generally normal to said second surface portion.

19. The coin analyzer apparatus in claim 16 wherein said control is capable of identifying a test coin in said test coin path as a particular one of a group of acceptable coins or tokens and wherein said test coin path is larger than the largest of said group, whereby said apparatus is capable of accepting and identifying multiple denominations of coins and/or tokens and rejecting slugs.

* * * * *

UNITED STATES PATENT AND TRADEMARK OFFICE

CERTIFICATE OF CORRECTION

PATENT NO. : 5,566,808
DATED : October 22, 1996
INVENTOR(S) : Donald O. Parker and Keith W. Parker It is certified that error appears in the above-identified patent and that said Letters Patent is hereby corrected as shown below:

Column 1, line 38:
".coin" should be --coin--.

Column 2, line 5:
".guide" should be --guide--.

Column 3, line 32:
"Faceplate-34" should be Faceplate 34--.

Column 6, claim 1, line 65:
":" should be --;--.

UNITED STATES PATENT AND TRADEMARK OFFICE

CERTIFICATE OF CORRECTION

PATENT NO. : 5,566,808

DATED : October 22, 1996

INVENTOR(S) : Donald O. Parker adn Keith W. Parker

It is certified that error appears in the above-identified patent and that said Letters Patent is hereby corrected as shown below:

Column 8, claim 9, line 36:
":" should be --;--.

Column 8, claim 9, line 38:
"Opening" should be --opening--.

Column 8, claim 9, line 42:
":" should be --;--.

Column 10, claim 16, line 15:
":" should be --;--.

Signed and Sealed this

Twentieth Day of June, 2000

*Attest:*

Q. TODD DICKINSON

*Attesting Officer*

*Director of Patents and Trademarks*